US005197863A

United States Patent [19]

Dardis et al.

[11] Patent Number: 5,197,863

[45] Date of Patent: Mar. 30, 1993

[54] BEARING FLUID DISTRIBUTION SYSTEMS FOR LIQUID RING PUMPS WITH ROTATING LOBE LINERS

[75] Inventors: Thomas R. Dardis, Stamford; Douglas E. Bissell, Bridgeport; Harold K. Haavik, Norwalk, all of Conn.

[73] Assignee: The Nash Engineering Company, Norwalk, Conn.

[21] Appl. No.: 824,187

[22] Filed: Jan. 22, 1992

Related U.S. Application Data

[63] Continuation-in-part of Ser. No. 635,233, Dec. 28, 1990, Pat. No. 5,100,300.

[51] Int. Cl.[5] ..... F04C 19/00

[52] U.S. Cl. ..... 417/68; 415/128; 415/116

[58] Field of Search ..... 417/68, 69; 415/128, 415/196, 197

[56] References Cited

U.S. PATENT DOCUMENTS 2,609,139 9/1952 Kollsman ..... 412/68

FOREIGN PATENT DOCUMENTS 587533 11/1933 Fed. Rep. of Germany .
1017740 10/1952 Fed. Rep. of Germany .
3115577 11/1982 Fed. Rep. of Germany .
212498 11/1940 Sweden .
219072 5/1968 U.S.S.R. .
309155 9/1971 U.S.S.R. .
1019109 5/1983 U.S.S.R. .
1021815 6/1983 U.S.S.R. .
1035290 8/1983 U.S.S.R. .
1038583 8/1983 U.S.S.R. .
1040221 9/1983 U.S.S.R. .
1195055 11/1985 U.S.S.R. ..... 417/68
1268809 11/1986 U.S.S.R. .
1392249 4/1988 U.S.S.R. .
1523727 11/1989 U.S.S.R. .

OTHER PUBLICATIONS

Lubenets et al., "The Results of Testing of Fluid-Ring Pump with Rotating Bushing", 1974.

Lubenets et al., "Effect of a Rotating Liner on the Characteristics of a Liquid Ring Machine", Plenum Publishing Corporation, 1984, pp. 121-123.

*Primary Examiner*—Richard A. Bertsch
*Assistant Examiner*—Michael I. Kocharov
*Attorney, Agent, or Firm*—Robert R. Jackson

[57] ABSTRACT

In liquid ring pumps having rotating lobe liners supported by a bearing fluid in an annular clearance between the liner and the surrounding housing, the housing has at least one substantially annular channel formed in the housing for distributing the bearing fluid to a plurality of circumferentially spaced apertures extending through the housing from the channel to the clearance.

26 Claims, 15 Drawing Sheets

FIG. 17
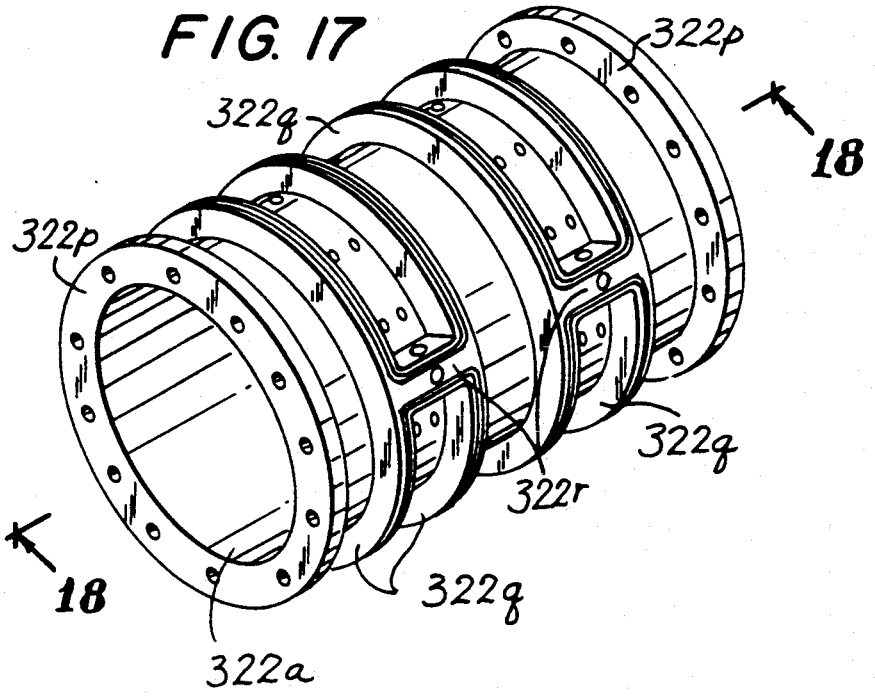
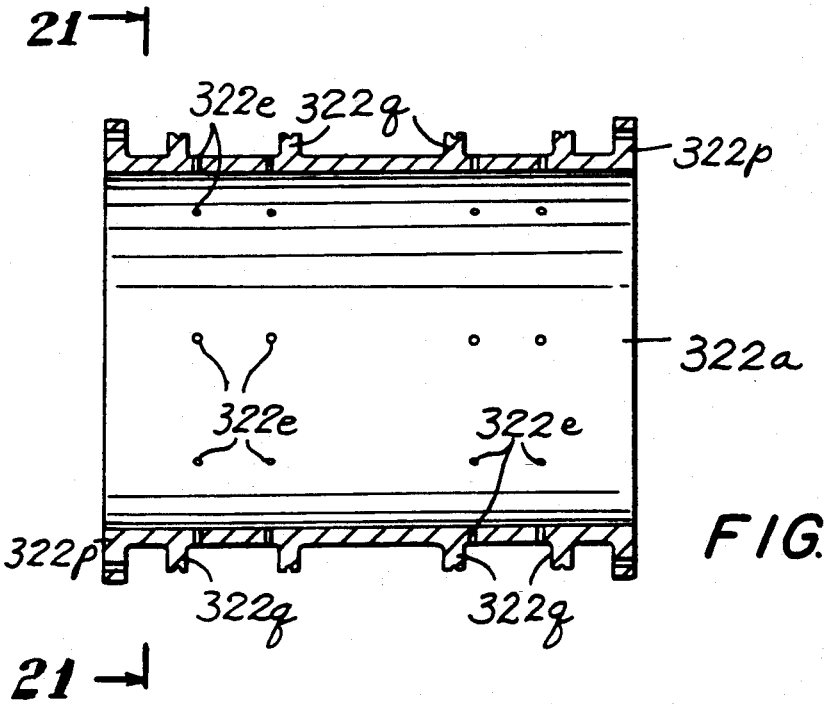
FIG. 18

BEARING FLUID DISTRIBUTION SYSTEMS FOR LIQUID RING PUMPS WITH ROTATING LOBE LINERS

This is a continuation-in-part of application Ser. No. 635,233, filed Dec. 28, 1990, now U.S. Pat. No. 5,100,300

BACKGROUND OF THE INVENTION

This invention relates to liquid ring pumps and more particularly to liquid ring pumps having lobe liners which rotate on an annular fluid bearing inside a stationary housing.

Liquid ring pumps having rotating lobe liners are well known as shown by such references as Kollsman U.S. Pat. No. 2,609,139 and Russian patent 219,072. In such pumps an annular liner is supported on an annular fluid bearing inside the stationary annular housing of the pump. Rotation of the rotor in the pump causes the pumping liquid in the pump to form into a recirculating annular ring inside the liner. This motion of the pumping liquid causes the liner to rotate in the same direction on its fluid bearing at a speed which is somewhat less than the speed of the pumping liquid. The rotating liner reduces fluid friction losses in the pump because it reduces the amount of rapidly recirculating pumping liquid which is in direct contact with the stationary housing.

The known references showing prior art pumps of the type described above recognize the need to introduce a bearing liquid into the annular clearance between the liner and housing at multiple points around the circumference of the pump. For example, this may be accomplished by withdrawing pumping liquid from the liquid ring at several circumferentially spaced points and conveying that liquid substantially axially from the withdrawal point to an associated bearing liquid introduction channel or aperture. This approach has several disadvantages. For example, it may not be desirable or possible to use ring liquid as the bearing fluid. The ring liquid may not be clean enough for use as the bearing fluid, or it may be desirable to use a bearing fluid which is different from the ring liquid. The liner may have end walls as shown in commonly assigned, co-pending application Ser. No. 635,233, filed Dec. 28, 1990 (hereby incorporated by reference herein) which may prevent withdrawal of liquid from the ring for use as a bearing fluid. Structure like that shown in Russian patent 219,072 necessitates large amounts of external piping for conveying the ring liquid from its multiple outlets to the bearing liquid inlets. Such piping is expensive, may be relatively fragile in some applications, and makes the pump at least appear excessively complex.

In view of the foregoing, it is an object of this invention to improve and simplify liquid ring pumps having rotating liners supported on annular fluid bearings.

It is a more particular object of this invention to improve and simplify the distribution of bearing fluid to the annular fluid bearing on which the rotating liner in liquid ring pumps having such liners is supported.

SUMMARY OF THE INVENTION

These and other objects of the invention are accomplished in accordance with the principles of the invention by using at least one circumferentially extending channel formed in the housing of a liquid ring pump to distribute bearing fluid to multiple circumferentially spaced apertures extending from the channel to the annular bearing clearance. The housing may be constructed in several different ways to provide the above-mentioned channel. For example, the housing may be made of concentric inner and outer portions with the channel formed between those portions. The inner and outer portions may be initially separate from one another and then put together in various ways, or the inner and outer portions may be formed integrally with one another. The inner and outer portions may be formed as completely annular structures, or the outer portion alone or both the inner and outer portions may be made up of plural (e.g., two) semi-annular segments which are releasably connected together. This may facilitate access to the liner if both the inner and outer portions are thus segmented. Alternatively or in addition, it may facilitate access to the channel and the associated apertures if the outer portion is thus segmented. The outer portion may have closable access ports radially aligned with some or all of the above-mentioned apertures to facilitate maintenance of the apertures.

Further features of the invention, its nature and various advantages will be more apparent from the accompanying drawings and the following detailed description of the preferred embodiments.

BRIEF DESCRIPTION OF THE DRAWINGS

FIG. 17 is a simplified perspective view of a portion of yet another alternative embodiment of the invention.

FIG. 18 is a sectional view taken along the line 18—18 in FIG. 17.

DETAILED DESCRIPTION OF THE PREFERRED EMBODIMENTS

Figure 1:
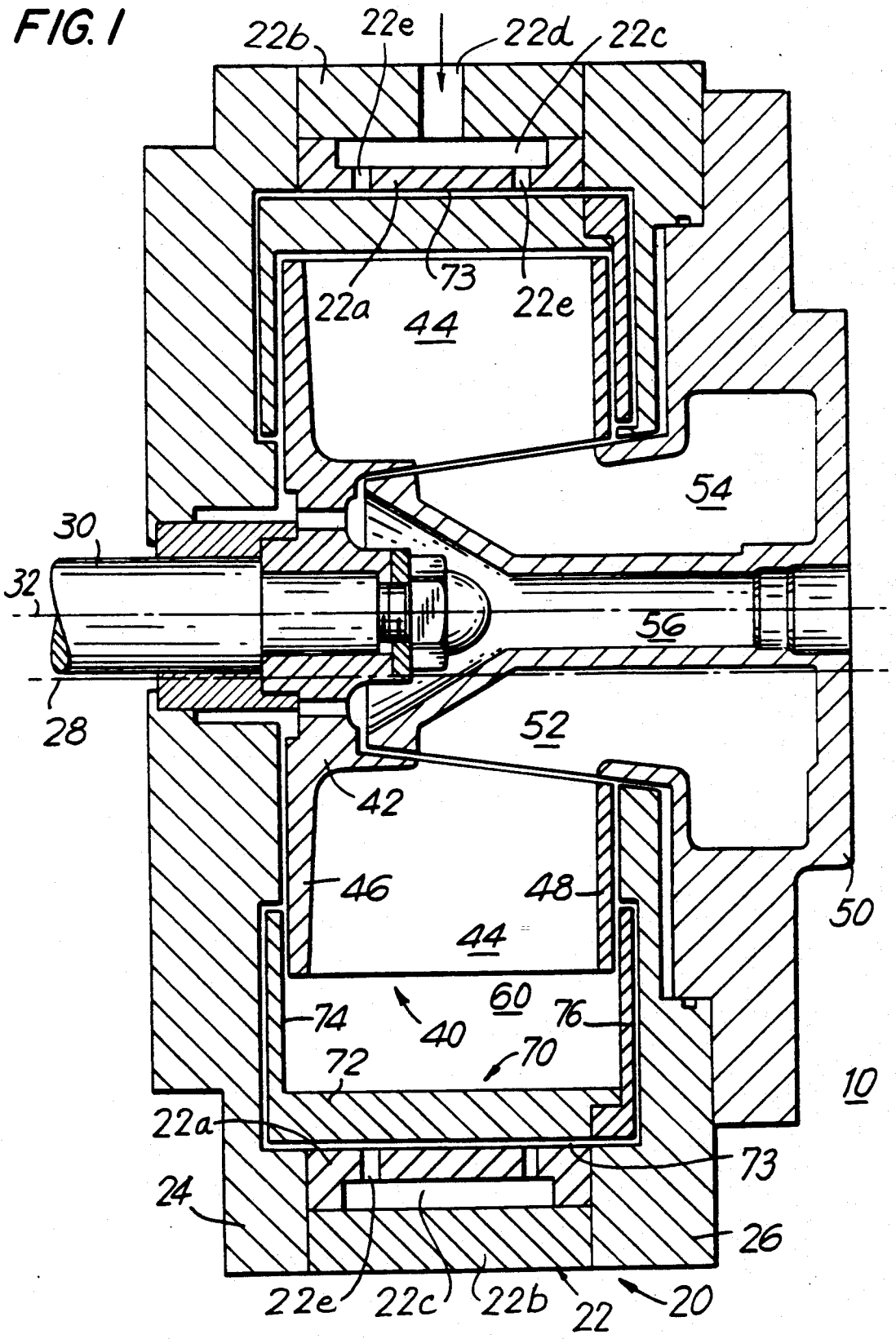
FIG. 1 is a simplified longitudinal sectional view of a first illustrative embodiment of a liquid ring pump constructed in accordance with the principles of this invention.
Figure 2:
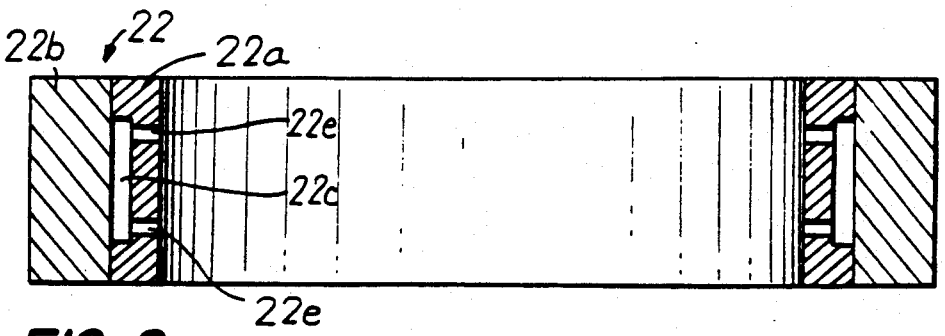
FIG. 2 is a simplified longitudinal sectional view (taken along the line 2—2 in FIG. 3) of certain elements of the pump of FIG. 1.
Figure 3:
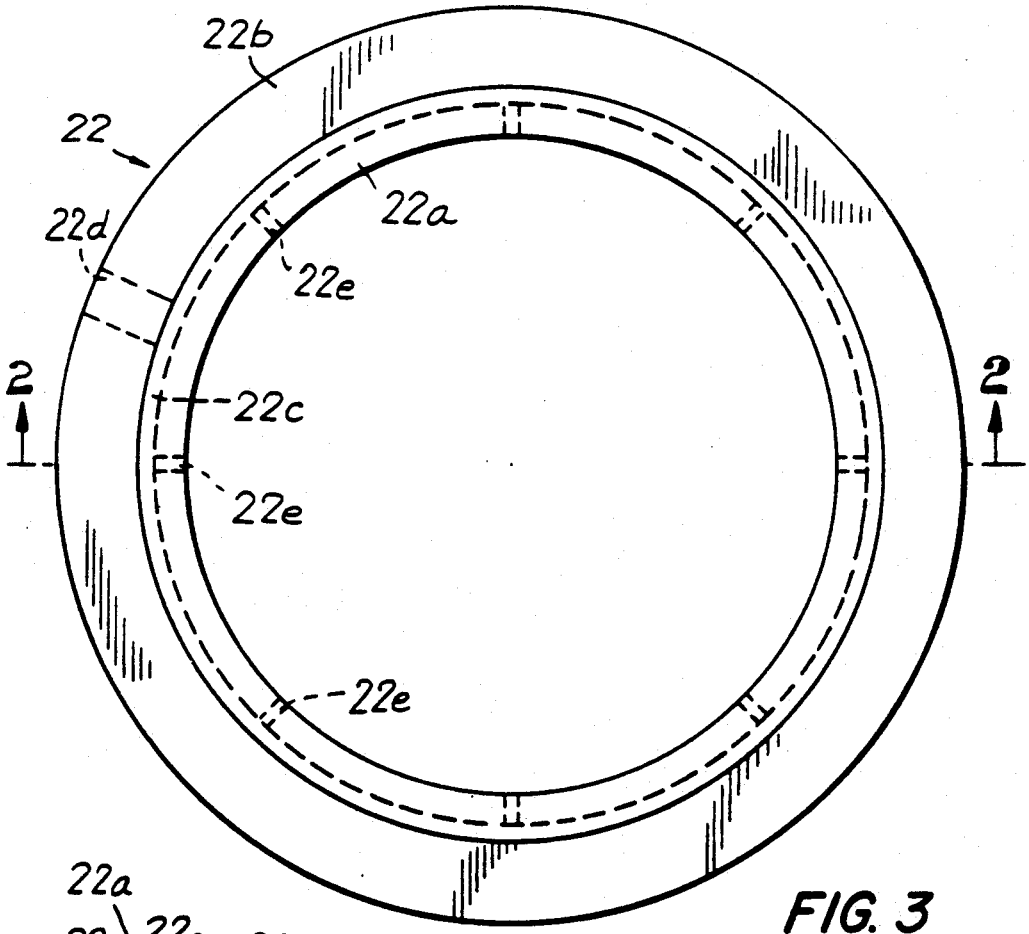
FIG. 3 is a simplified axial end view of the pump elements shown in FIG. 2.

A first illustrative embodiment of the invention is like that shown in FIGS. 1 and 2 of above-mentioned application Ser. No. 635,233. Because this embodiment is fully discussed in that application, it will not be necessary to repeat all the details regarding this embodiment here. Only the main features of this embodiment, with emphasis on the features which are especially pertinent to the present invention, will be discussed below. Accompanying FIGS. 1-4 show the presently relevant aspects of this embodiment.

As shown in FIG. 1, an illustrative liquid ring pump 10 constructed in accordance with this invention comprises a housing 20 including annular main body part 22, drive end cover plate 24, and idle end cover plate 26. Main body part 22 is concentric with axis 28. A rotor 40 is mounted inside housing 20 on shaft 30 which projects into the housing through drive end cover plate 24. Rotation of shaft 30 about axis 32 rotates rotor 40 about that axis. Axis 32 is substantially parallel to but laterally offset from axis 28.

Rotor 40 has hub 42 from which a plurality of circumferentially spaced, radially and axially extending blades 44 project. Blades 44 extend axially between annular drive end rotor shroud 46 and annular idle end rotor shroud 48. A frustoconical portion of port member 50 projects into a complementary frustoconical recess in the idle end of rotor 40. Port member 50 includes a gas inlet passage 52 for admitting to rotor 40 the gas which is to be compressed by the pump. Port member 50 also includes a gas discharge passage 54 for receiving from rotor 40 gas which has been compressed by the pump. Passages 52 and 54 are respectively connected to external intake and discharge conduits (not shown).

A liner 70 is disposed inside housing 20 concentric with axis 28. Liner 70 includes annular main body 72, annular end wall 74 at the drive end of main body 72, and annular end wall 76 at the idle end of main body 72. Although liner end walls like end walls 74 and 76 are included in the preferred embodiments of the invention, they can be omitted if desired. Liner main body 72 is spaced from housing main body 22 by a small annular clearance 73. Liner end walls 74 and 76 are also spaced from the adjacent stationary portions of housing 20 by small clearances. A bearing fluid is introduced into these clearances as will be discussed in more detail below. Accordingly, liner 70 can rotate on this fluid bearing about axis 28.

A quantity of pumping liquid (e.g., water) is introduced into and maintained in housing 20 (e.g., via passageway 56 in port member 50). Rotation of rotor 40 by shaft 30 causes rotor blades 44 to engage this liquid and form it into a recirculating annular ring which is substantially concentric with axis 28. Because rotor axis 32 is eccentric to axis 28, the inner surface of the liquid ring is moving radially out from axis 32 on the side of the pump adjacent gas inlet passage 52, thereby pulling gas into the spaces between rotor blades 44 on that side of the pump. On the opposite side of the pump the inner surface of the liquid ring is moving radially in toward axis 32, thereby compressing the gas in the spaces between the rotor blades on that side of the pump. This compressed gas exits from the pump via gas discharge passage 54. Because the rotating liquid ring is in contact with liner 70, the liner rotates in the same direction as the liquid ring, albeit at a somewhat lower speed than the liquid ring. The fluid bearing in the clearance 73 between the liner and the housing supports the liner for this rotation. The presence of the rotating liner reduces fluid friction losses in the pump because the liner reduces the amount of the rotating liquid ring which is in contact with the stationary housing.

Figure 4:
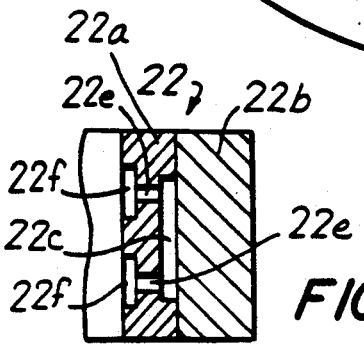
FIG. 4 is a view similar to a portion of FIG. 2 showing a possible modification in accordance with this invention.
Figure 6:
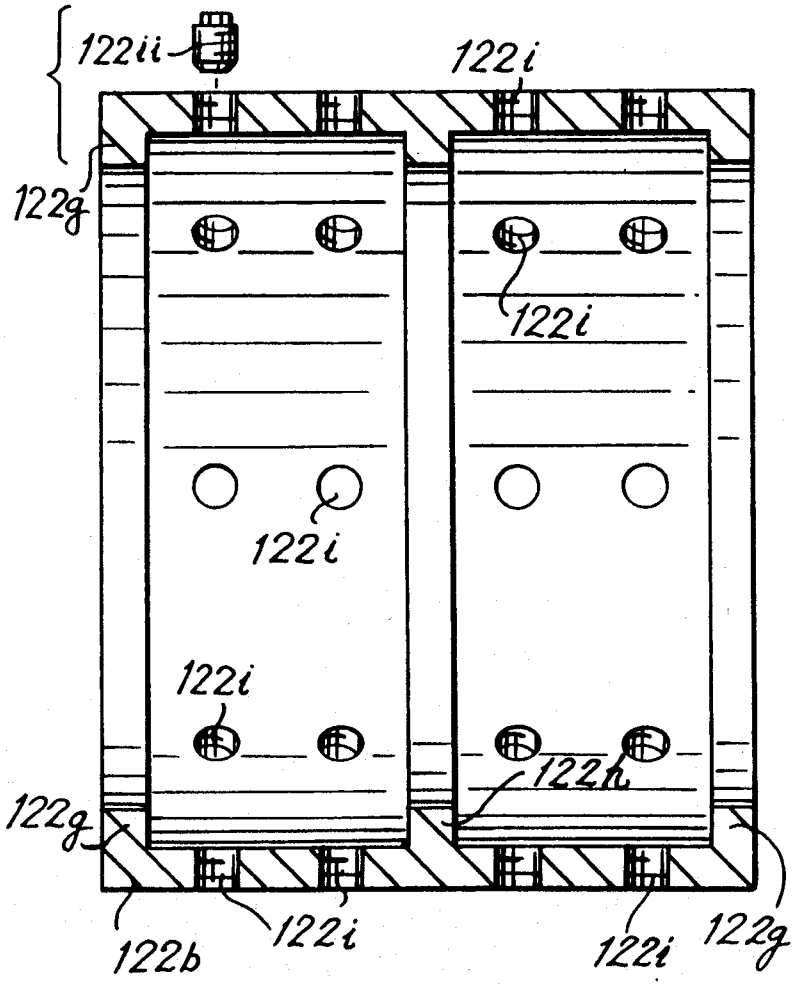
FIG. 6 is a sectional view taken along the line 6—6 in FIG. 5.
Figure 5:
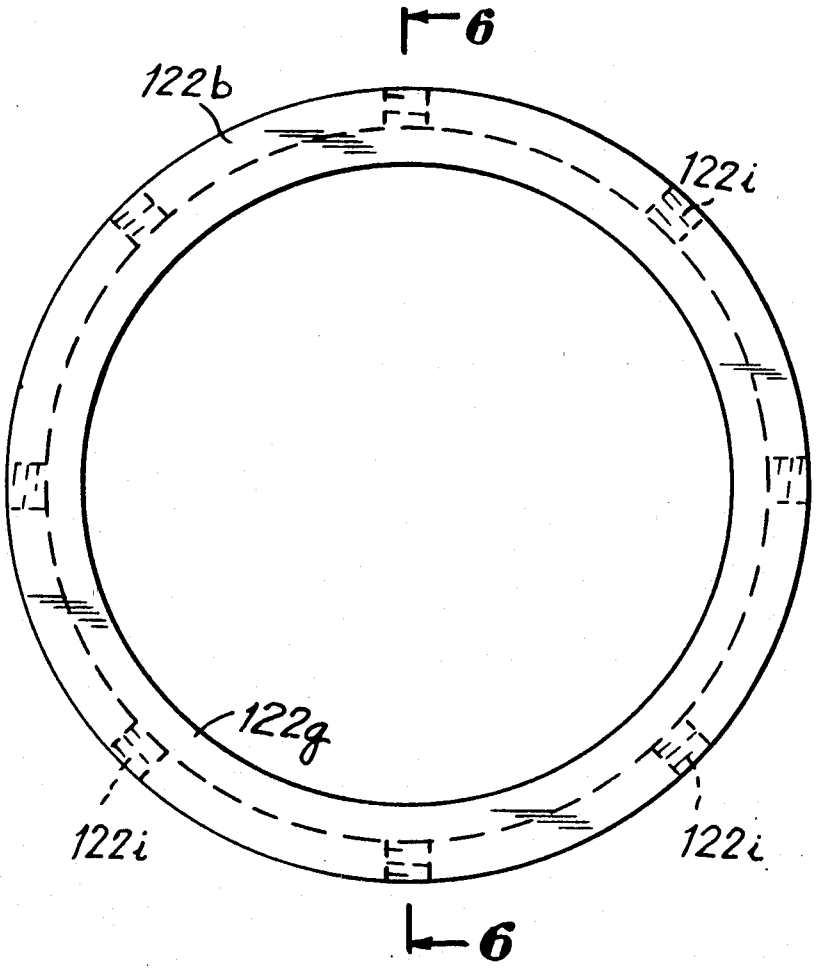
FIG. 5 is a view generally similar to FIG. 3 showing one element of another alternative embodiment of the invention.
Figure 8:
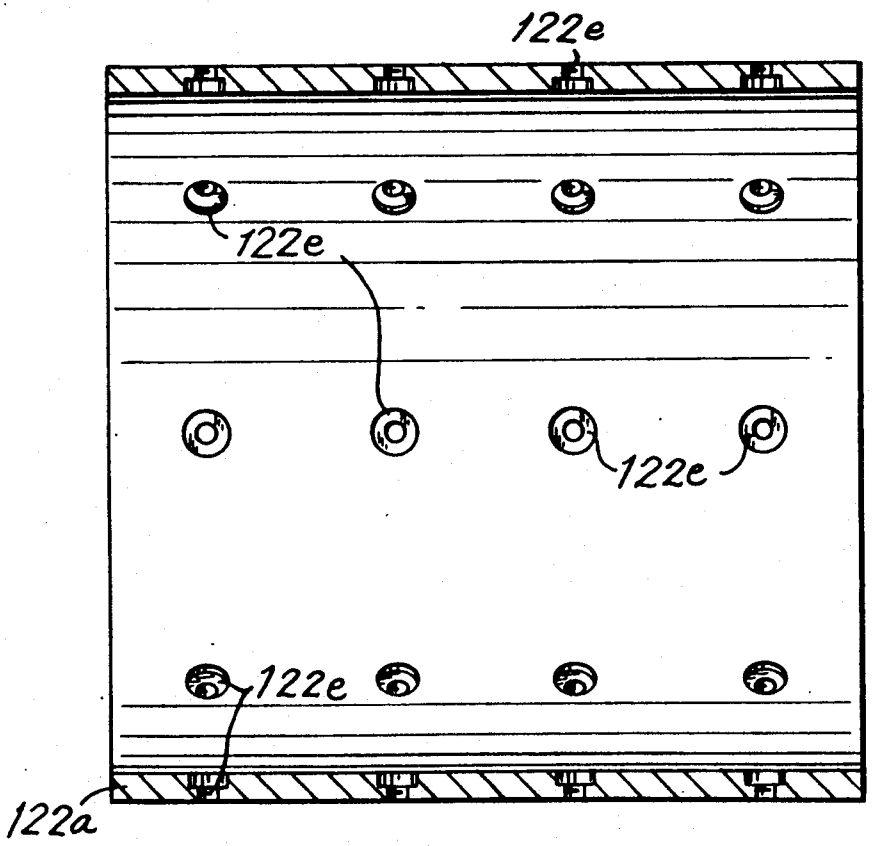
FIG. 8 is a sectional view taken along the line 8—8 in FIG. 7.
Figure 7:
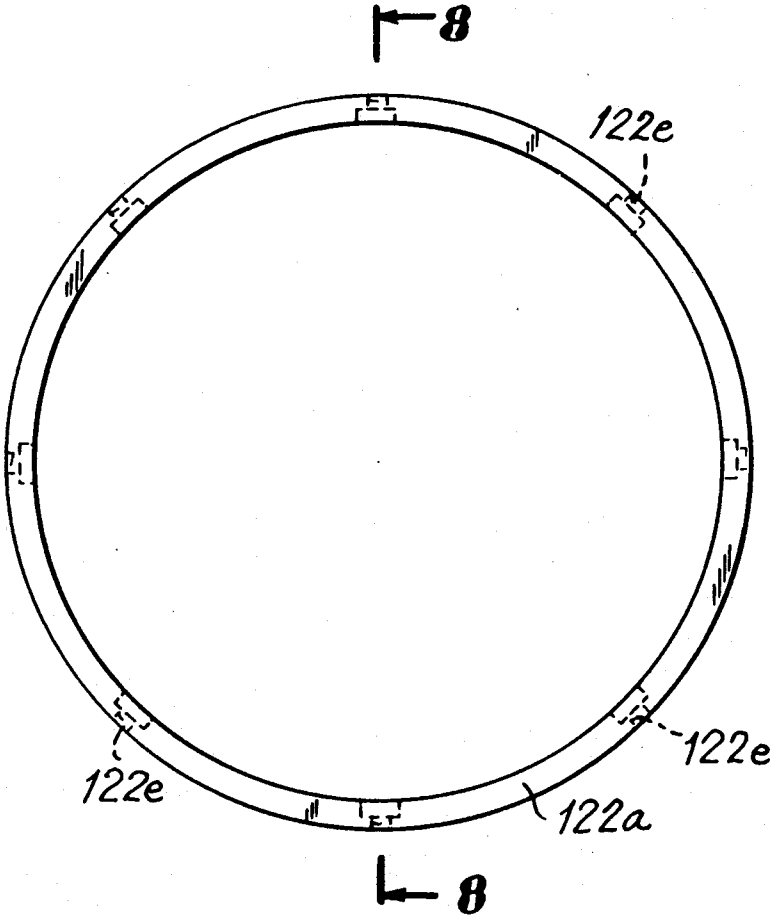
FIG. 7 is a view generally similar to FIG. 5 showing another element of the embodiment shown in FIG. 5.

To facilitate start-up of the liner, as well as to ensure that the liner bearing fluid is well distributed throughout clearance 73, it is desirable t introduce the bearing fluid (which may be the same as the pumping liquid, or which may be any other suitable fluid) into clearance 73 at several points which are circumferentially spaced around the pump. In the illustrative embodiment shown in FIGS. 1-4 this is accomplished by constructing the main body 22 of housing 20 as two concentric annular portions 22*a* and 22*b*. Inner portion 22*a* has radially extending bearing fluid delivery apertures 22*e* bored or otherwise formed in it. These apertures are distributed circumferentially around the pump and possibly also axially along the pump. Inner portion 22*a* has outwardly extending flanges adjacent to each of its ends so that annular channel 22*c* is formed between these flanges, the remainder of inner portion 22*a*, and outer portion 22*b*. Bearing fluid is supplied to channel 22*c* at a suitable pressure via opening 22*d* in outer portion 22*b*. As mentioned above, this bearing fluid may be the same as the pumping liquid used in the liquid ring, or it may be any other suitable fluid. The bearing fluid entering the pump via opening 22*d* flows circumferentially around the pump in channel 22*c* and enters clearance 73 via each of apertures 22*e*. If desired, apertures 22*e* may be configured as shown in FIG. 4, for example, with enlarged plenums 22*f* at their outlets to increase the hydrostatic pressure bearing force. The hydrostatic force generated in the vicinity of the plenums supports the liner, thereby facilitating the initiation of rotation of the liner. As liner speed increases, the hydrodynamic film lubrication becomes more significant in supporting the radial load on the liner.

Main body 22 may be fabricated in any desired way. For example, inner portion 22*a* may be made of bronze with machined inner and outer surfaces, while outer portion 22*b* may be cast iron with its inner surface machined. Inner portion 22*a* may then be press fit into outer portion 22*b*. The bronze inner portion gives long service even in a relatively corrosive environment. The cast iron outer portion helps lower cost.

Figure 9:
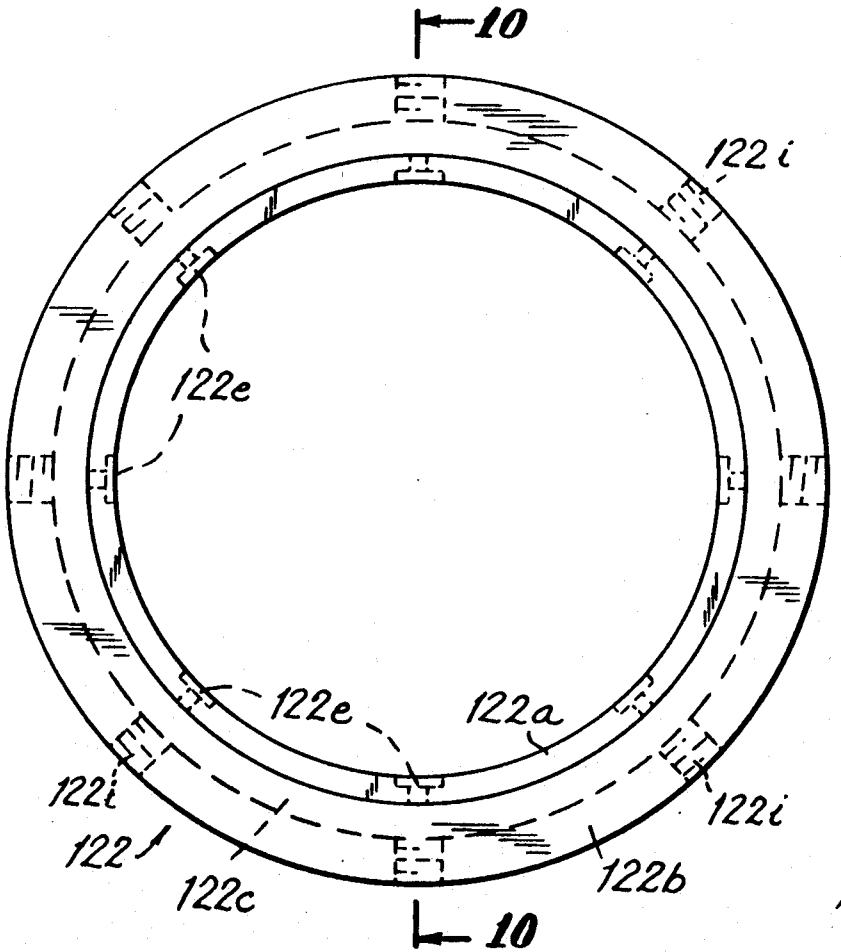
FIG. 9 is a view generally similar to FIG. 7 showing the elements of FIGS. 5 and 7 in assembled condition.
Figure 11:
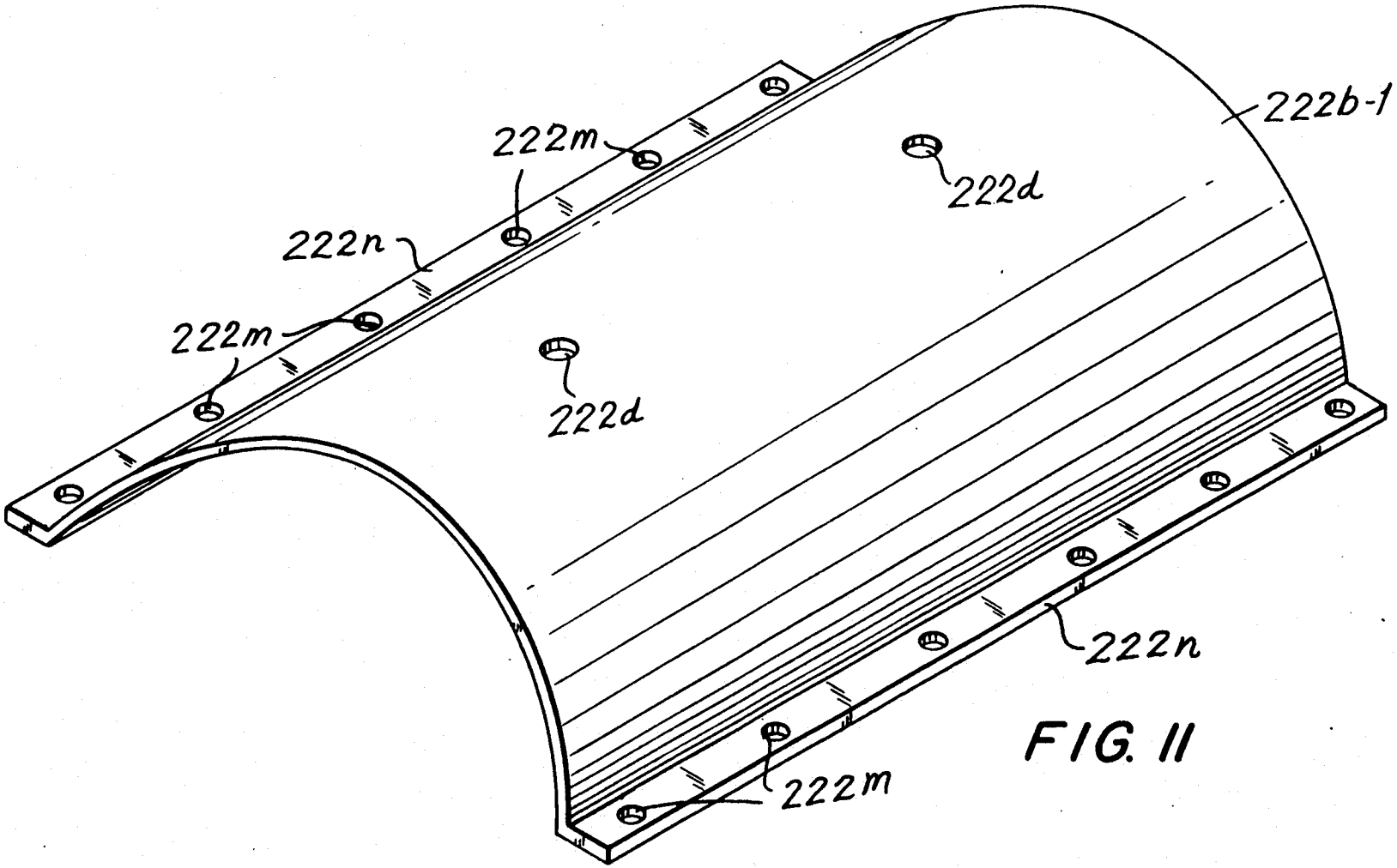
FIG. 11 is a simplified perspective view of one part of still another alternative embodiment of the invention.
Figure 13:
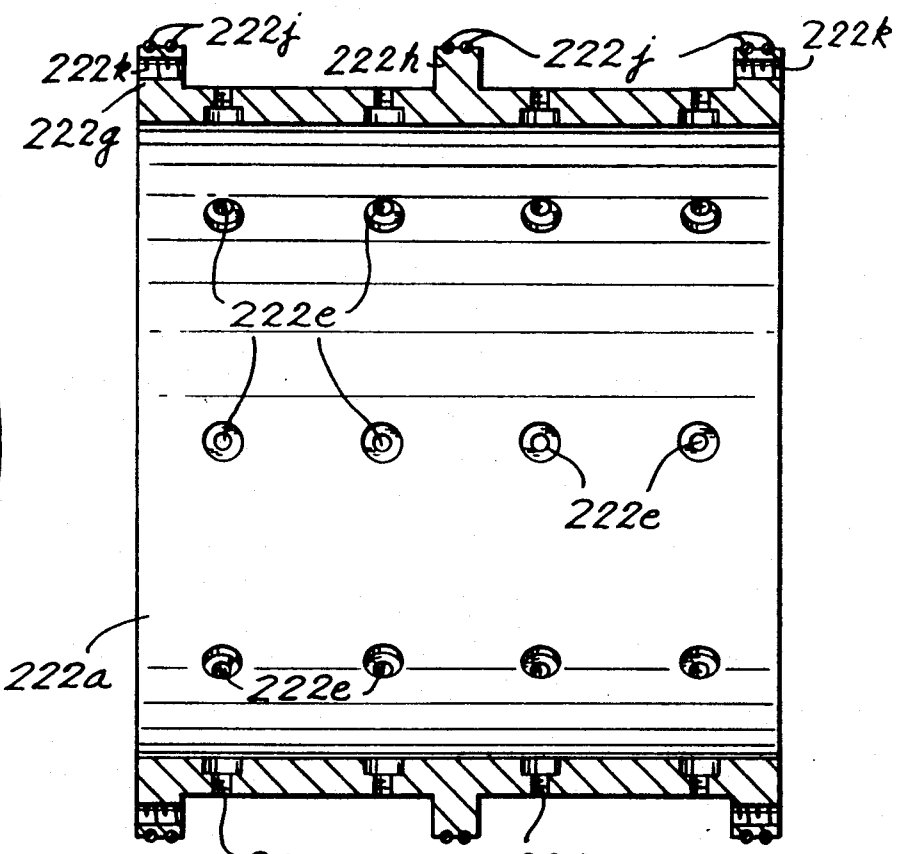
FIG. 13 is a sectional view taken along the line 13—13 in FIG. 12.
Figure 12:
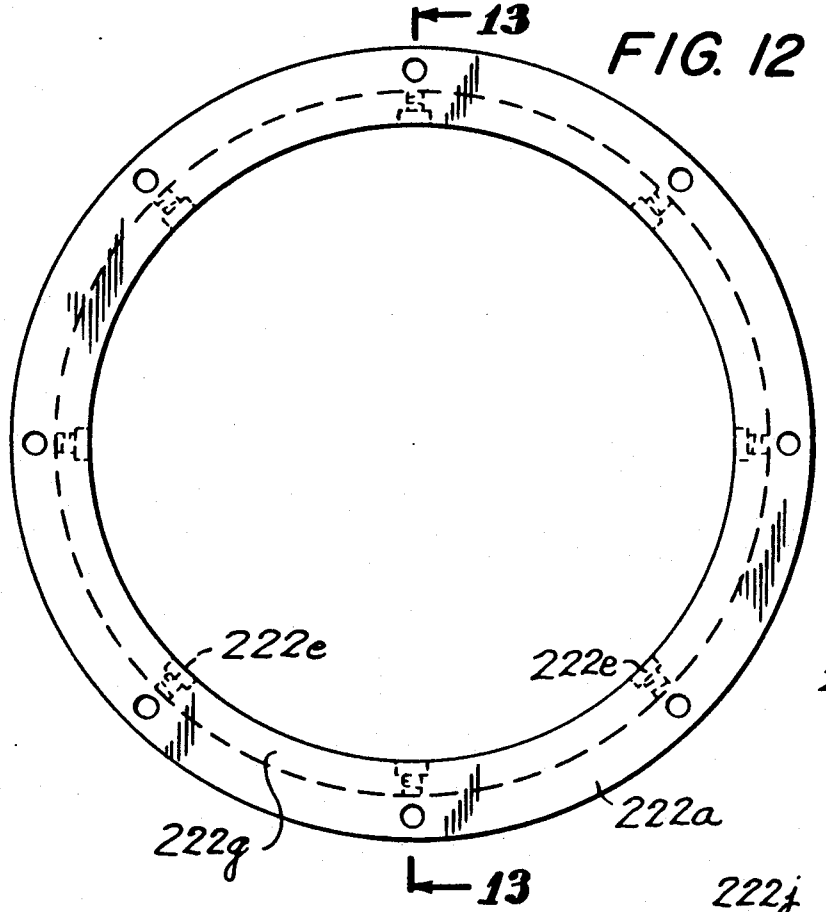
FIG. 12 is a simplified axial end view of another part of the embodiment of FIG. 11.

FIGS. 5–10 show an alternative embodiment of a pump main body part 122 which is generally similar to the embodiment of FIGS. 1–4 but which may be suitable for somewhat longer liquid ring pumps (e.g., as shown in FIG. 9 of above-mentioned application Serial No. 635,233), and which may also include other features which will now be discussed. (Although FIG. 9 in the above-mentioned application shows a double-ended liquid ring pump having a single rotating liner, it will be understood that each end of such a pump could have a separate rotating liner. In addition, a radially inwardly projecting center shroud could be provided on the housing between such separate liners to more completely axially divide the pump. This principle can be used in any of the relatively long pump embodiments described herein, if desired.)

Figure 10:
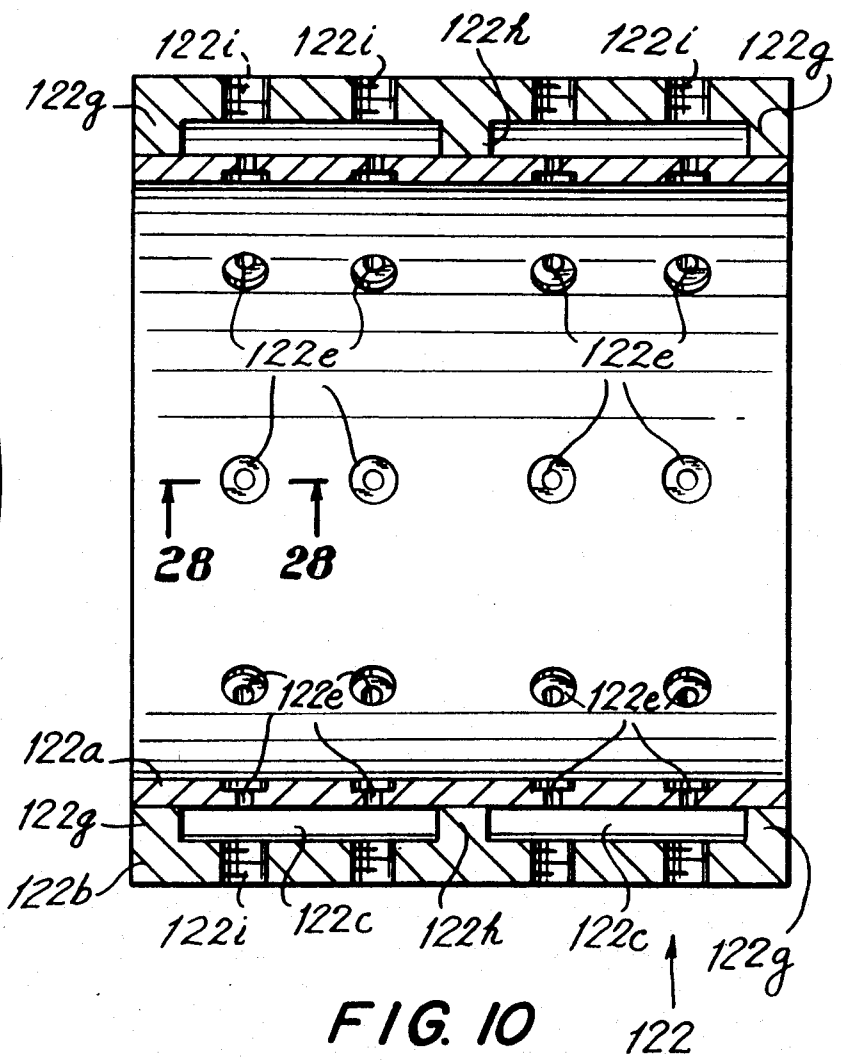
FIG. 10 is a sectional view taken along the line 10—10 in FIG. 9.

In the embodiment shown in FIGS. 5–10 radially inwardly extending annular end flanges 122*g* on outer portion 122*b* take the place of the radially outwardly projecting end flanges on the inner portion 22*a* of the first embodiment. Outer portion 122*b* also has a third radially inwardly extending annular flange 122*h* centrally located along the length of outer portion 122*b*. Accordingly, when inner portion 122*a* is press fit into outer portion 122*b* as shown in FIGS. 9 and 10, two annular channels 122*c* are formed. Centrally located flange 122*h* also helps to support, align, and reinforce inner portion 122*a*. Once again, inner portion 122*a* may be made of bronze or other higher cost but relatively corrosion-resistant and long-wearing material, while outer portion 122*b* is made of a lower cost material such as cast iron. The inner and outer surfaces of inner portion 122*a* are preferably machined, while only the inner surfaces of each of outer portion flanges 122*g* and 122*h* require machining. The fit between flange 122*h* and inner portion 122*a* does not have to be as tight as the fit between flanges 122*g* and inner portion 122*a* because it does not matter if bearing fluid leaks between the two channels 122*c*.

Inner portion 122*a* has a plurality of circumferentially spaced apertures 122*e* extending radially through the inner portion from each of annular channels 122*c* to the annular bearing fluid clearance immediately inside the inner portion. Apertures 122*e* may be bored through inner portion 122*a* with the size required to permit delivery of bearing fluid to the annular clearance inside portion 122*a* at the pressure and flow rate needed to provide the hydrostatic and hydrodynamic film which supports the rotating liner. Alternatively, apertures 122*e* may be constructed as shown, for example, in FIGS. 28–30. As shown in those FIGS., each aperture 122*e* includes an orifice plug 600 threaded into an aperture in inner portion 122*a* (or the comparable portion of any other suitable embodiment). Each orifice plug 600 has a fluid metering orifice 602 formed through it for conveying bearing fluid from channel 122*c* (or the like in other embodiments) to the annular clearance 73 outside the rotating liner. A tool-receiving recess 604 is provided in each orifice plug 600 for allowing a tool to be used to thread plug 600 into or out of inner portion 122*a*. In this way orifice plugs 600 can be removed for maintenance of metering orifices 602 (e.g., periodic cleaning of the metering orifices to remove scaling deposits or particulate matter which may accumulate from insufficiently clean bearing fluid). Alternatively or in addition, plugs 600 can be removed and replaced with other plugs having metering orifices 602 of a different size if it is desired to change the size of the metering orifices.

In order to allow for inspection and/or service of apertures 122*e* (including removal and replacement of orifice plugs 600 if such plugs are employed) without having to remove the rotor and the rotatable liner from the pump, outer portion 122*b* has a closable access port 122*i* radially aligned with each of apertures 122*e*. A plug (a representative one of which is shown at 122*ii* in FIG. 6) is threaded into each of access ports 122*i* to close it. When it is desired to gain access to any of apertures 122*e* (including any orifice plugs 600 used as part of the aperture structures), the plug in the radially aligned port 122*i* can be temporarily removed. If orifice plugs 600 are used, ports 122*i* are preferably large enough to permit removal of each orifice plug through the associated port. One of the access ports 122*i* which communicates with each channel 122*c* can be used as the bearing fluid inlet for that channel. Alternatively, a separate bearing fluid inlet can be provided for each channel 122*c* so as not to obstruct any of access ports 122*i*.

Figure 14:
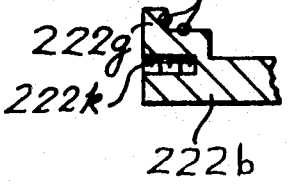
FIG. 14 is a simplified view similar to the upper left-hand corner of FIG. 13 showing a possible variation.
Figure 15:
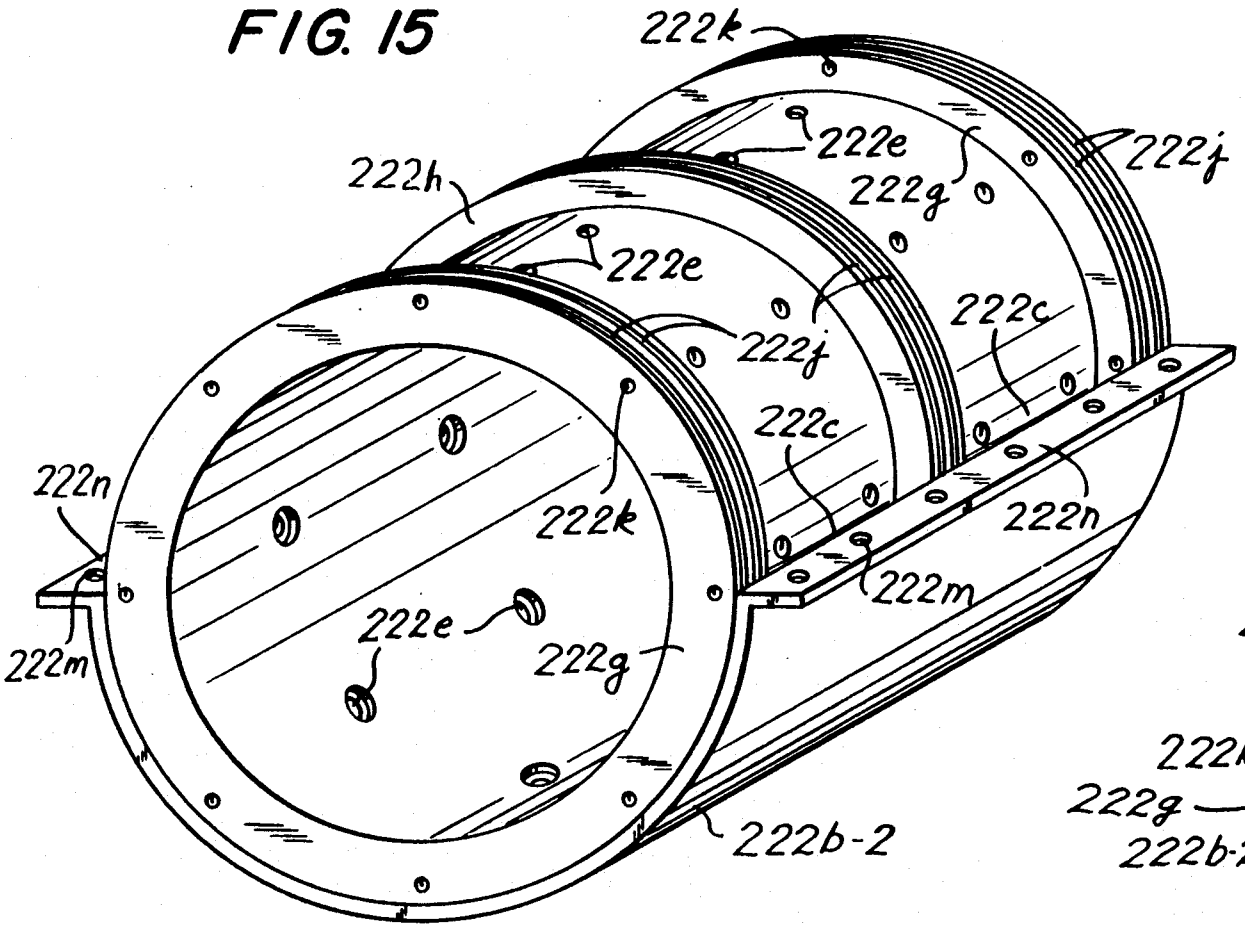
FIG. 15 is a simplified perspective view of portions of the embodiment of FIGS. 11–13.
Figure 16:
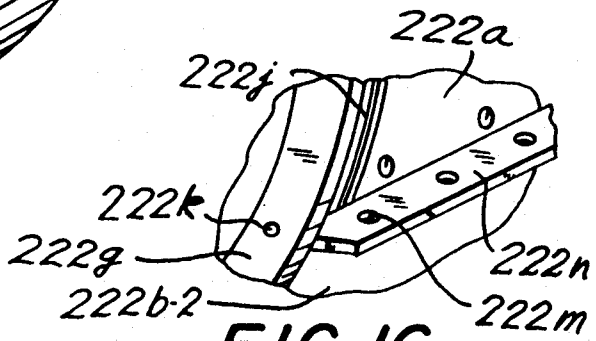
FIG. 16 is similar to a portion of FIG. 15 adapted for the variation of FIG. 14.
Figure 19:
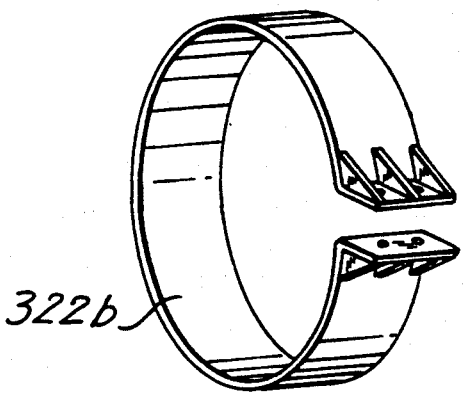
FIG. 19 is a simplified perspective view of another portion of the embodiment of FIGS. 17 and 18.
Figure 20:
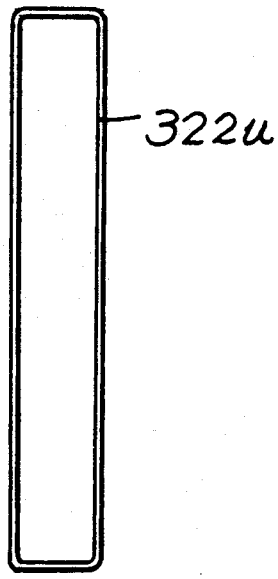
FIG. 20 is an elevational view of an O-ring gasket member for use in the embodiment of FIGS. 17-19.
Figure 21:
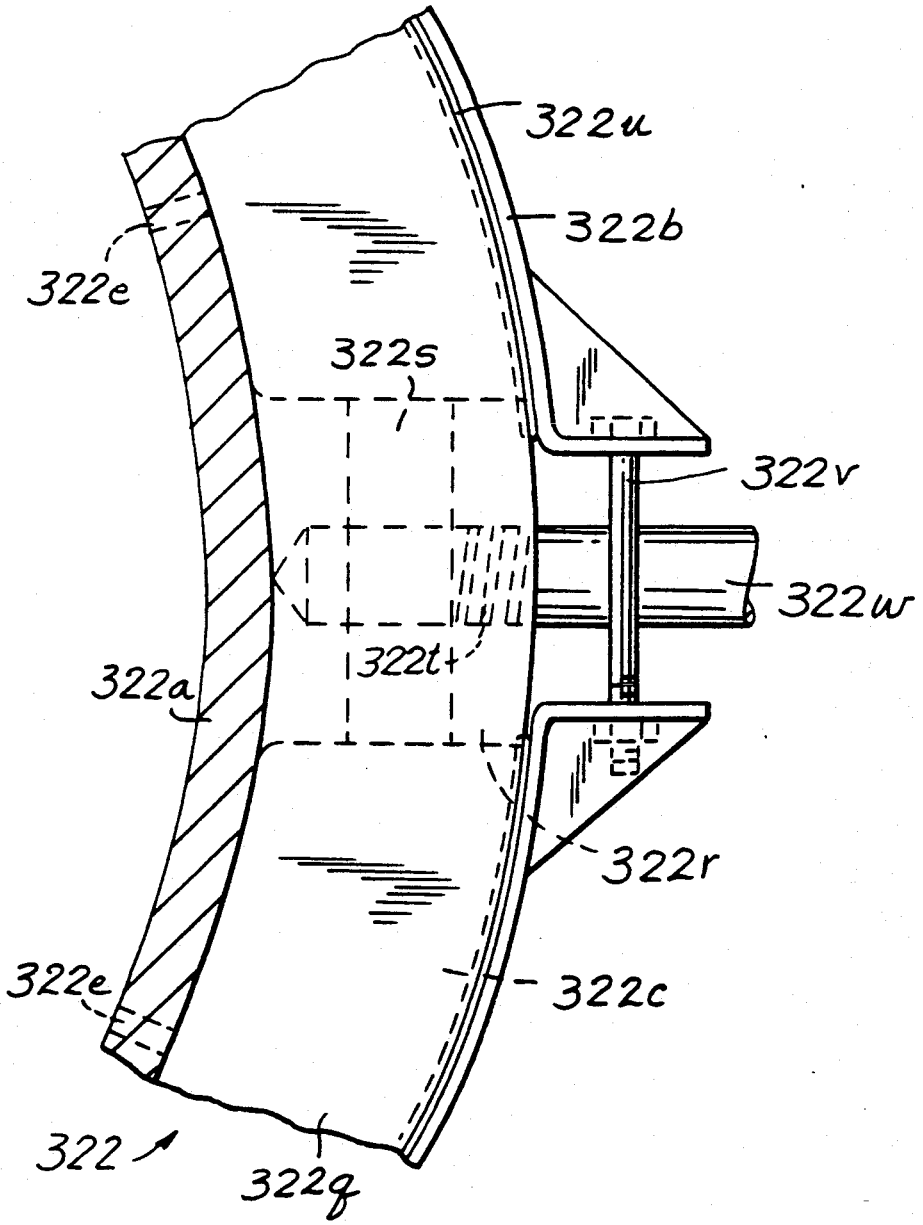
FIG. 21 is a simplified, partial sectional view taken along the line 21—21 in FIG. 18 with the elements of FIGS. 19 and 20 assembled on the element of FIG. 18.

FIGS. 11–16 show alternative embodiments in which outer portion 222*b* is made in two semi-annular halves 222*b*-1 and 222*b*-2. The inner portion 222*a* in these embodiments is basically similar to inner portion 122*a* in the embodiment which has just been described. However, instead of a press fit between the inner and outer portions, in these embodiments rubber O-rings 222*j* or other suitable gaskets are used between the inner portion flanges 222*g* and 222*h* and outer portion 222*b*. (FIGS. 14 and 16 show a variation in which end flanges 222*g* have both annularly and axially operative O-rings.) Apertures 222*k* are provided to facilitate attachment of the head members (not shown) at the axial ends of the pump. The two halves of outer portion 222*b* are secured together by bolts through apertures 222*m* in flanges 222*n*. This compresses O-rings 222*j* to produce seals between the inner and outer portion 222*a* and 222*b*. Bearing fluid is supplied to each of annular bearing fluid distribution channels 222*c* via bearing fluid inlets 222*d* in one or both of outer portions 222*b*-1 and 222*b*-2. Removal of one or both of outer portions 222*b*-1 and 222*b*-2 permits access to annular bearing fluid channels 222*c* and apertures 222*e* (which may again include orifice plugs 600 as shown, for example, in FIGS. 28–30) without the need to remove the rotor or rotatable liner of the pump. In other respects the embodiments of FIGS. 11–16 may be similar to the embodiment of FIGS. 5–10.

FIGS. 17–21 show yet another embodiment in which inner portion 322*a* of pump main body portion 322 is an annular member as in the previously discussed embodiments, and outer portions 322*b* are strap-like members which fit around the outside of the inner portion to complete the definition of annular bearing fluid distribution channels 322*c*. Inner portion 322*a* has end flanges 322*p* which in this case are not used to help define channels 322c, but rather are used only to facilitate attachment of the end members (not shown) of the pump. Between end flanges 322p inner portion 322a has one or more pairs of annular flanges 322q. At one location around the circumference of inner portion 322a the flanges 322q in each of these pairs are interconnected by an axially extending flange 322r. Each flange 322r has a circumferentially extending passageway 322s bored through it. A radially extending passageway 322t passageway is bored from the outer surface of each flange 322r into the flange to interconnect with the passageway 322s in that flange. Each pair of annular flanges 322q and the associated axially extending flange 322r has a shallow channel for receiving an elongated rectangular O-ring or a simple flat gasket 322u (see FIG. 20). This O-ring or flat gasket extends most of the way around one annular flange 322q, extends along axial flange 322r to the other flange 322q, extends back in the opposite direction around that flange 322q, and then extends back to the first flange 322q along axial flange 322r. O-ring or flat gasket 322u does not enclose the aperture which leads into passageway 322t from outside inner portion 322a.

Each pair of flanges 322q and the passageway 322s through the associated axial flange 322r collectively comprise an annular channel 322c which is covered by a substantially annular, strap-like outer portion 322b. Outer portion 322b fits over the associated flanges 322q and 322r, but does not cover the entrance to passageway 322t in the associated flange 322r. Bolts 322v are used to pull the adjacent ends of outer portion 322b toward one another. This tightens outer portion 322b down on the associated O-ring or gasket 322u, thereby forming a seal between outer portion 322b and inner portion 322a. A bearing fluid supply conduit 322w may be attached to each of passageways 322t.

Figure 28:
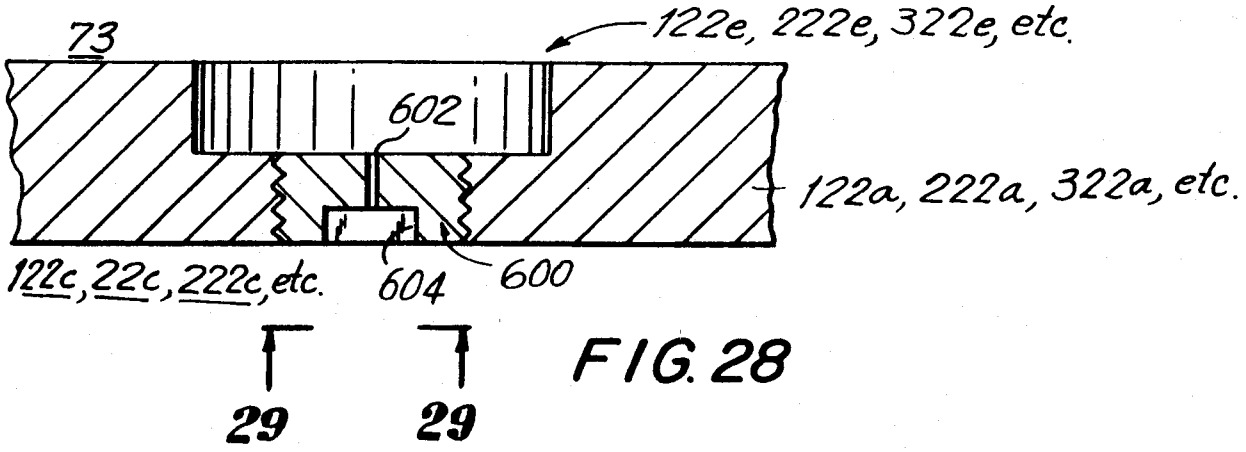
FIG. 28 is a partial sectional view taken along the line 28—28 in FIG. 10 (but also applicable to several other embodiments) showing in more detail how a representative portion of the pumps of this invention may be constructed.
Figure 30:
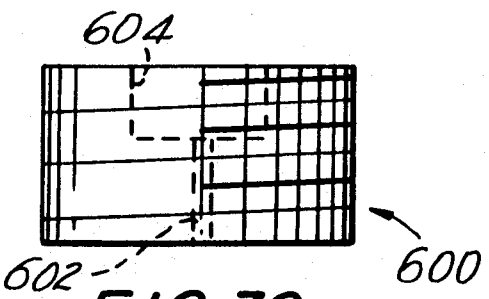
FIG. 30 is a side view of the part shown in FIG. 29.
Figure 29:
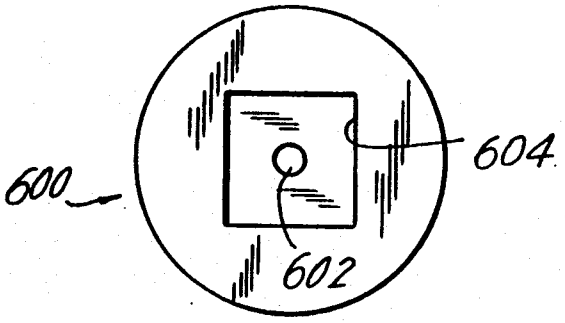
FIG. 29 is a view taken in the direction indicated by the arrows 29—29 in FIG. 28 showing one part of the apparatus shown in FIG. 28.

Except as discussed above, the embodiment of FIGS. 17–21 may be similar to the previously discussed embodiments. Thus inner portion 322a has circumferentially spaced apertures 322e (which may include orifice plugs 600 as shown in FIGS. 28–30 and described above) leading from each of annular channels 322c into the bearing fluid clearance which is immediately inside the inner portion. To gain access to the apertures (including orifice plugs 600, if employed) and the associated channel 322c, each outer portion 322b can be loosened (via bolts 322v) and the outer portion slid off the associated flanges 322q and 322r.

Figure 23:
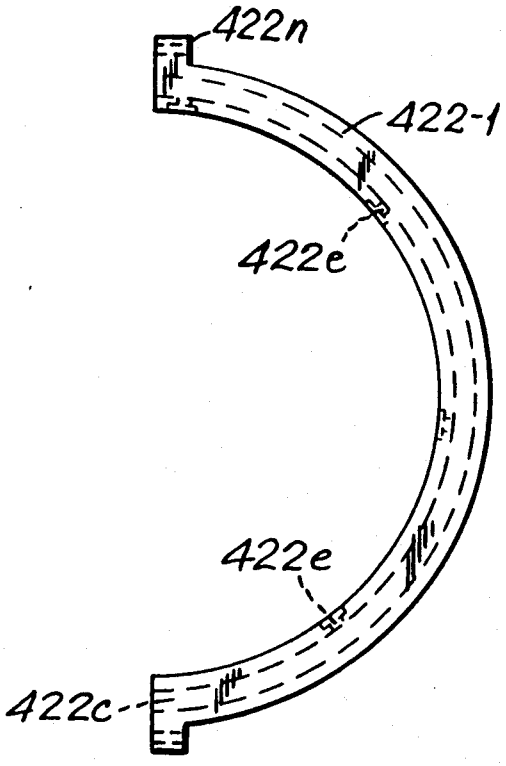
FIG. 23 is a simplified axial end view of the part shown in FIG. 22.
Figure 22:
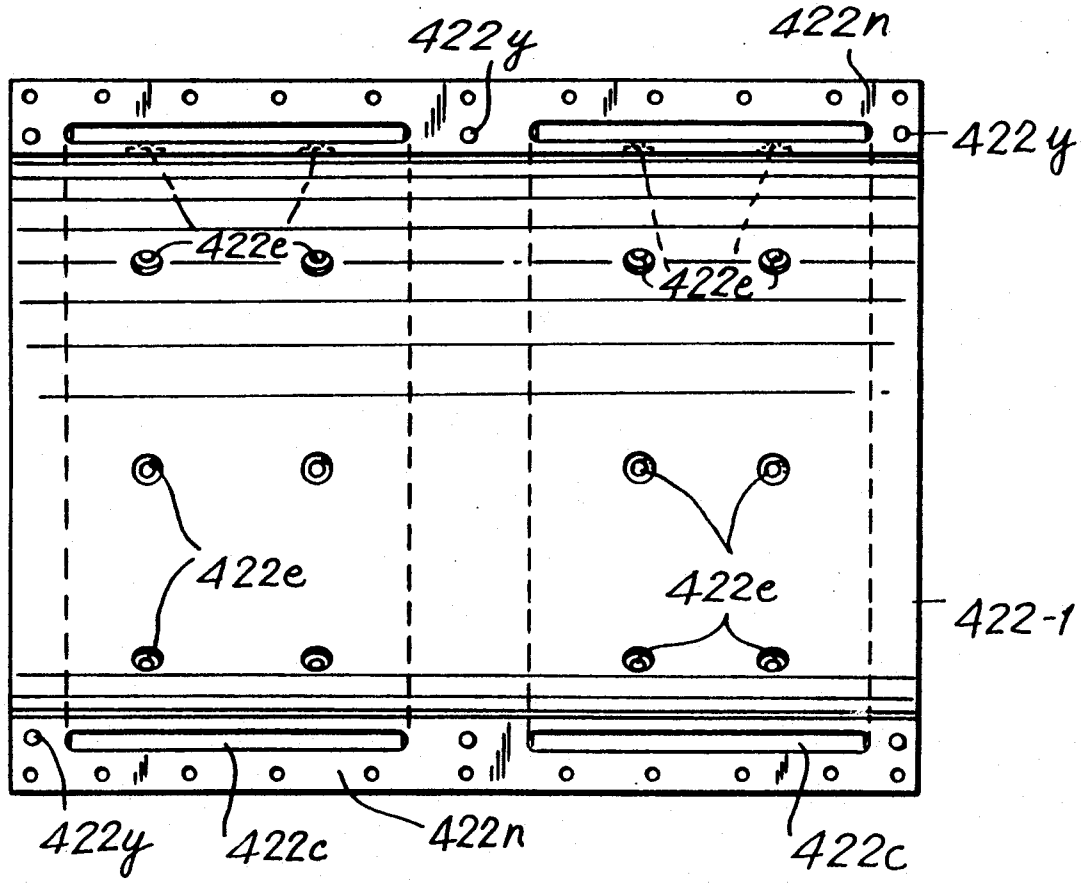
FIG. 22 is a simplified elevational view of a part of still another alternative embodiment of the invention.
Figure 24:
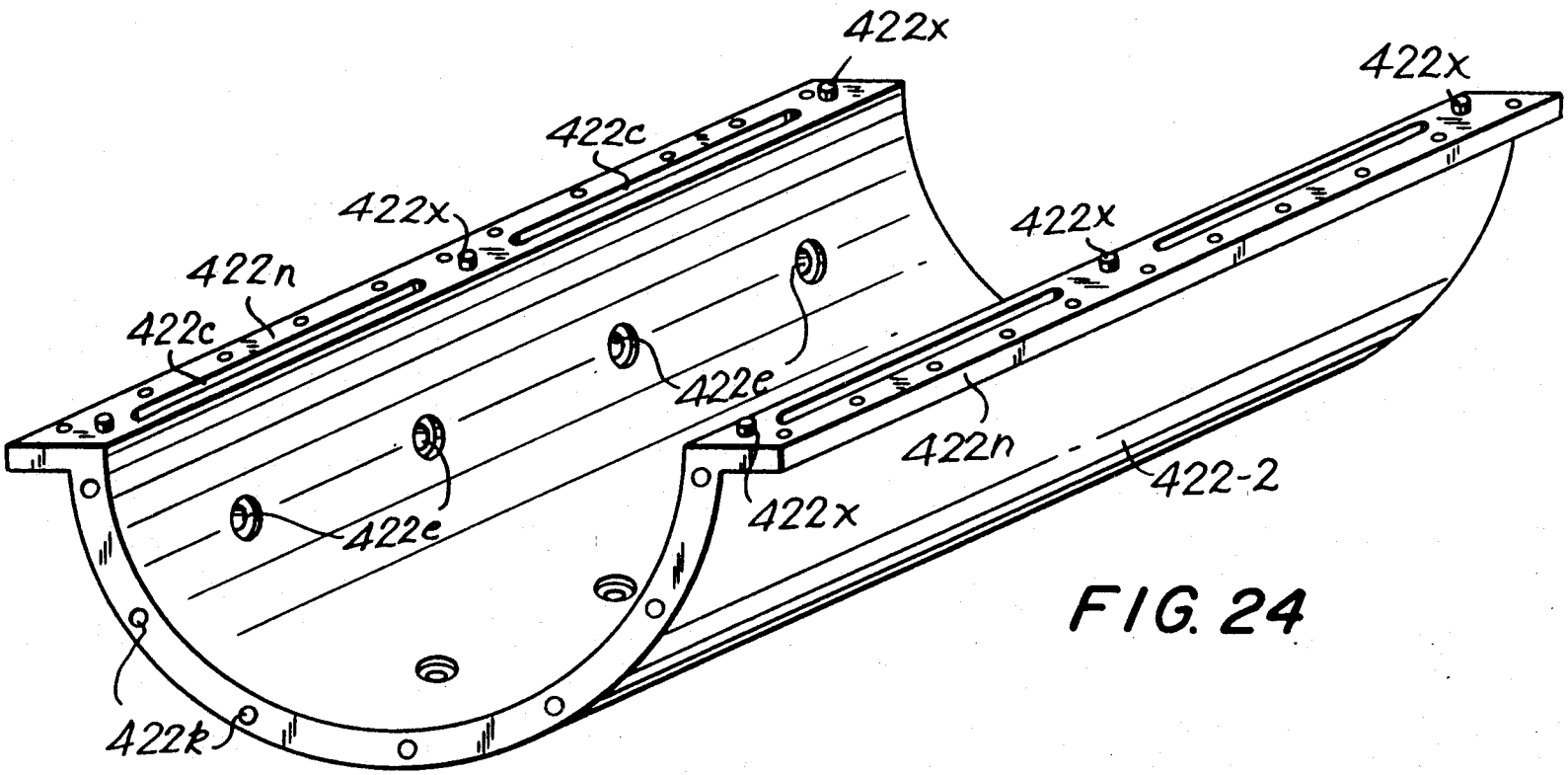
FIG. 24 is a simplified perspective view of the part which mates with the part shown in FIGS. 22 and 23.

FIGS. 22–24 show still another embodiment in which the inner and outer portions of main body part 422 are integral with one another, but the main body part is formed as two semi-annular segments 422-1 and 422-2. Each of segments 422-1 and 422-2 is formed with two circumferentially extending channels 422c. Circumferentially spaced apertures 422e (which may again include orifice plugs of the type shown in FIGS. 28–30, although in this instance recesses 604 should be on the inner end of each orifice plug when the plugs are installed) are formed through the inner wall of these channels in order to distribute bearing fluid from channels 422c to the annular bearing fluid clearance which is immediately inside the main body part. Segments 422-1 and 422-2 are joined to one another at their flanges 422n to form a completely annular structure with annular channels 422c. channels 422c is supplied with bearing fluid via an aperture (not shown) through the outer wall of the channel. Alignment pins 422x on one of the segments (e.g., 422-2) are received in apertures 422y in the other segment (e.g., 422-1) to help ensure precise alignment of the two segments. Holes 422k are provided for attachment of the end members of the pump (not shown). The bearing fluid clearance immediately inside main body part 422, as well as apertures 422e (including orifice plugs 600, if employed) and channels 422c, can be inspected and maintained by removing one or both of segments 422-1 and 422-2 without further disassembly of the pump.

Figure 26:
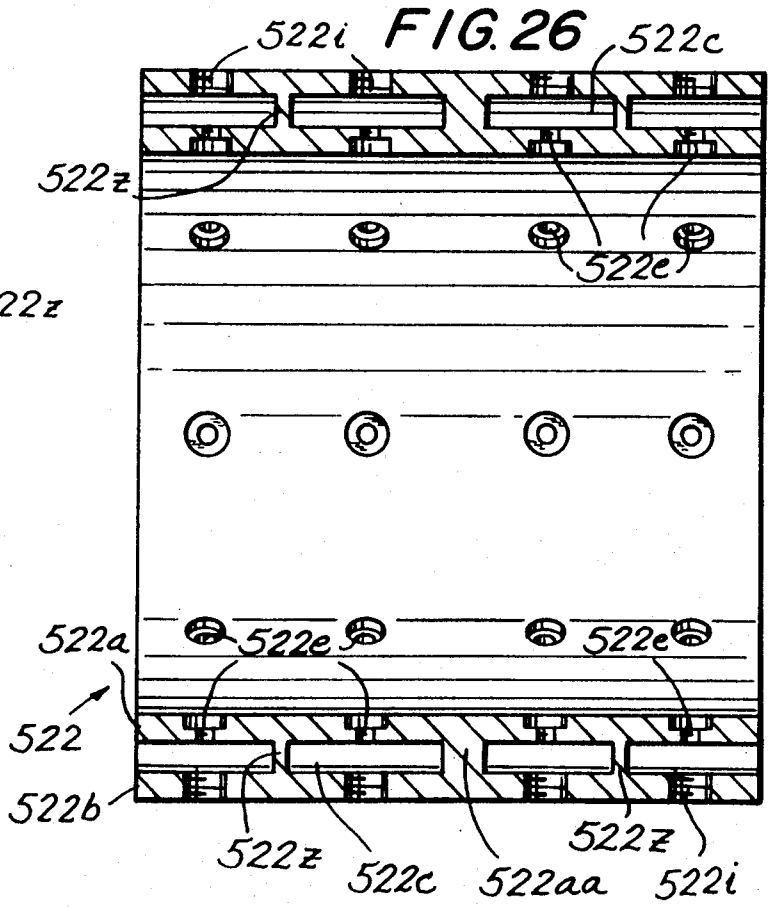
FIG. 26 is a sectional view taken along the line 26—26 in FIG. 25.
Figure 25:
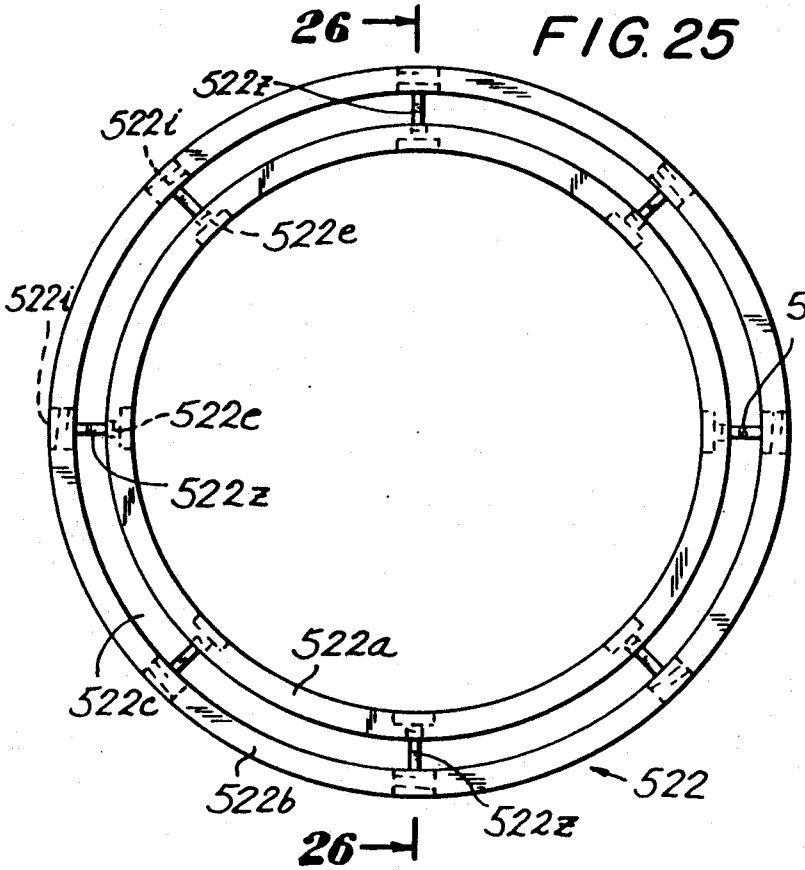
FIG. 25 is a simplified axial end view of a portion of yet another alternative embodiment of the invention.
Figure 27:
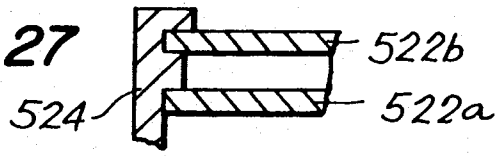
FIG. 27 is similar to a portion of FIG. 26 and shows how another part of the pump may mate with the part shown in FIG. 26.

Still another illustrative embodiment of the invention is shown in FIGS. 25–27. As in the embodiment just discussed, the inner and outer portions of the main body part 522 in this embodiment are again integral. However, in this embodiment main body part 522 between the inner portion 522a and the outer portion 522b are left open to facilitate fabrication (e.g., by casting). Stiffening ribs 522z of limited circumferential extent are left between inner and outer portions 522a and 522b at locations which are circumferentially spaced around the pump. Inner and outer portions 522a and 522b are also joined to one another by annular connection 522aa which is located halfway between the axial ends of main body part 522. Accordingly, annular connection 522aa divides the remaining space between portions 522a and 522b into two annular channels 522c. The axial ends of these channels are closed by the end members (e.g., end member 524 in FIG. 27) of the pump. Bearing fluid is supplied to each of channels 522c via apertures in outer portion 522b. This fluid is distributed to the clearance immediately inside main body portion 522 via apertures 522e through inner portion 522a. Apertures 522e are circumferentially spaced around the pump. Again, these apertures may include orifice plugs 600 as illustrated by FIGS. 28–30 and described above. As in the embodiment shown in FIGS. 5–10, each aperture 522e has an associated radially aligned access port 522i through outer portion 522b. Access ports 522i are normally closed by plugs (not shown), but can be opened for such purposes as inspection and maintenance of apertures 522e (including orifice plugs 600, if employed).

It will be understood that the foregoing is merely illustrative of the principles of the invention, and that various modifications can be made by those skilled in the art without departing from the scope and spirit of the invention. For example, the number and placement of bearing fluid distribution apertures 22e, 122e, 222e, 322e, 422e, and 522e can be varied greatly as desired.

The invention claimed is:

1. A liquid ring pump comprising:

a stationary annular housing having a central longitudinal axis surrounded by said housing;

a rotor disposed in said housing for rotation about a rotation axis which is substantially parallel to said longitudinal axis;

an annular liner member disposed in said housing concentric with said longitudinal axis, the radially outer surface of said liner member being spaced from the adjacent inner surface of said housing by an annular clearance;

means for maintaining a quantity of pumping liquid in said housing, said pumping liquid being formed into a recirculating annular ring inside said liner member by rotation of said rotor; and means for introducing a bearing fluid into said annular clearance so that said liner member rotates on said bearing fluid about said longitudinal axis as a result of recirculation of said pumping liquid in said annular ring, said means for introducing comprising at least two circumferentially spaced apertures in said inner surface of said housing, a channel extending through and enclosed within said housing between said at least two apertures, and means for supplying bearing fluid to said channel so that said bearing fluid flows through said channel and enters said annular clearance via said apertures.

2. The apparatus defined in claim 1 wherein said housing comprises:

a substantially annular inner portion which is substantially concentric with said longitudinal axis;

a substantially annular outer portion which is also substantially concentric with said longitudinal axis and outside of said inner portion; and means for spacing a circumferentially extending portion of an outer surface of said inner portion from an adjacent circumferentially extending portion of an inner surface of said outer portion in order to define said channel.

3. The apparatus defined in claim 2 wherein said means for spacing comprises:

a first circumferentially extending flange on one of said inner and outer portions, said first flange extending radially between said inner and outer portions; and a second circumferentially extending flange on one of said inner and outer portions, said second flange being spaced from said first flange parallel to said longitudinal axis and extending radially between said inner and outer portions, said channel being between said first and second flanges.

4. The apparatus defined in claim 3 wherein said first and second flanges are on said outer portion.

5. The apparatus defined in claim 3 wherein said first and second flanges are on said inner portion.

6. The apparatus defined in claim 5 wherein each of said first and second flanges is substantially annular and wherein said outer portion comprises:

a semi-annular member having circumferentially spaced ends, the width of said semi-annular member parallel to said longitudinal axis being greater than the spacing between said first and second flanges parallel to said longitudinal axis, said semi-annular member being removably positionable on said inner portion so that the width of said semi-annular member spans the spacing between said first and second flanges; and means for releasably drawing said first and second ends toward one another to seal said semi-annular member against said first and second flanges.

7. The apparatus defined in claim 6 wherein said inner portion further comprises a rib extending substantially parallel to said longitudinal axis between said first and second flanges, and wherein said means for drawing draws said first and second ends toward said rib to additionally seal said semi-annular member against said rib.

8. The apparatus defined in claim 7 further comprising a passageway from an entrance in the radially outer surface of said rib into the space between said first and second flanges, wherein said means for drawing leaves said entrance open, and wherein said means for supplying supplies said bearing fluid to said entrance.

9. The apparatus defined in claim 7 further comprising:

an annular seal member which extends along the radially outer surface of said first flange to said rib, along the radially outer surface of said rib to said second flange, along the radially outer surface of said second flange back to said rib, and along the radially outer surface of said rib back to said first flange.

10. The apparatus defined in claim 2 wherein said apertures extend through said inner portion.

11. The apparatus defined in claim 10 further comprising:

an access port associated with each of said apertures, each of said access ports extending through said outer portion in substantial radial alignment with the associated aperture; and means for removably closing each of said access ports.

12. The apparatus defined in claim 10 wherein each of said apertures is disposed in an orifice plug member mounted in said inner portion.

13. The apparatus defined in claim 12 wherein each of said orifice plug members is removably mounted in said inner portion.

14. The apparatus defined in claim 13 wherein each of said orifice plug members is threaded into said inner portion.

15. The apparatus defined in claim 13 further comprising:

an access port associated with each of said apertures, each of said access ports extending through said outer portion in substantial radial alignment with the associated aperture for permitting the orifice plug in each aperture to be removed from the pump via the associated access port when the access port is open; and means for removably closing each of said access ports.

16. The apparatus defined in claim 2 wherein said outer portion comprises at least two semi-annular segments and means for releasably joining said segments together to form said substantially annular outer portion.

17. The apparatus defined in claim 16 wherein each of said semi-annular segments is approximately one-half of an annulus in circumferential extent.

18. The apparatus defined in claim 2 wherein each of said inner and outer portions comprises at least two semi-annular segments and means for releasably joining said segments together to form said substantially annular inner and outer portions.

19. The apparatus defined in claim 18 wherein each of said semi-annular segments of said inner portion is integral with a radially adjacent one of the semi-annular segments of said outer portion.

20. The apparatus defined in claim 18 wherein each of said semiannular segments is approximately one-half of an annulus in circumferential extent.

21. The apparatus defined in claim 2 wherein said inner and outer portions are integral with one another.

22. The apparatus defined in claim 2 wherein said inner and outer portions have opposite first and second axial ends which are spaced from one another parallel to said longitudinal axis, and wherein at least one of said first and second axial ends has an opening which communicates with said channel.

23. The apparatus defined in claim 2 wherein said inner and outer portions are assembled by being press fit to one another parallel to said longitudinal axis.

24. The apparatus defined in claim 2 wherein said inner and outer portions are respectively made from different materials.

25. The apparatus defined in claim 24 wherein said inner portion is made of a relatively high cost, corrosion-resistant material and said outer portion is made of a relatively low cost material.

26. The apparatus defined in claim 25 wherein said inner portion is made of bronze and said outer portion is made of cast iron.

* * * * *